United States Patent [19]

Fayerman et al.

[11] Patent Number: 4,569,547

[45] Date of Patent: Feb. 11, 1986

[54] DOOR HANDLE MOUNT

[75] Inventors: Peter Fayerman, Douglassville; Elwood Shaffer; Paul James, Jr., both of Reading, all of Pa.

[73] Assignee: Baldwin Hardware Corporation, Reading, Pa.

[21] Appl. No.: 583,829

[22] Filed: Feb. 27, 1984

[51] Int. Cl.[4] ..... E05C 1/16

[52] U.S. Cl. ..... 292/347; 292/336.3; 292/DIG. 60; 292/DIG. 61

[58] Field of Search ..... 74/470, 551.2; 292/347, 292/336.3, 173, DIG. 60, DIG. 61

[56] References Cited

U.S. PATENT DOCUMENTS

| | | | |
|---|---|---|---|
| 412,189 | 10/1889 | Kingsland . | |
| 2,470,771 | 5/1949 | Harvey | 292/173 |
| 2,631,878 | 3/1953 | Backhouse | 292/169 |
| 2,727,773 | 12/1955 | Hagstrom | 292/169 |
| 2,729,485 | 1/1956 | Schlage | 292/1 |
| 2,985,478 | 5/1961 | Russell | 292/336.3 |
| 3,156,495 | 11/1964 | Holden | 292/336.3 |
| 3,211,486 | 10/1965 | Crandell | 292/348 |
| 3,418,867 | 12/1968 | Maeda | 74/470 X |
| 3,954,292 | 5/1976 | Johnson | 292/169.17 |
| 4,042,268 | 8/1977 | Coglan | 292/347 |
| 4,071,270 | 1/1978 | Alexander | 292/169.22 |
| 4,123,097 | 10/1978 | Allemann | 292/336.3 |
| 4,453,753 | 6/1984 | Fayerman et al. | 292/347 X |

*Primary Examiner*—Richard E. Moore

*Attorney, Agent, or Firm*—Steele, Gould & Fried

[57] ABSTRACT

A door handle mount for a door having a rotatable spindle for operating a latch includes a lever handle cantilevered on the spindle and a trim plate having a spring resiliently biasing the spindle to seek a home position. The home position sought by the trim plate spring may be changed by relocating a movable stop. The user selectively biases the home position of the spindle to accommodate the cantilevered weight of the lever handle, to alter the bias from one direction to the other, or to temporarily cancel the bias during installation of the latch mechanism and trim.

6 Claims, 8 Drawing Figures

U.S. Pat. No. 2,729,485—Schlage shows a coil spring disposed in the trim on the surface of a door, the coil spring being adapted to maintain a lever handle at a home position. Heavier springs are recommended in connection with heavier lever handles, and the heavier springs are mounted in trim mechanisms associated especially with such handles. The device relates spring tension to the lever handle, but even given the foregoing description, Schlage fails to employ a movable home position, whereby installation is facilitated and the device is equally applicable to either side of the door. Instead, Schlage uses the device with a spindle which is rotatable in either direction to withdraw the bolt. Accordingly, with wear on the springs, the Schlage device will be expected to sag, the unequal load caused by the cantilevered lever handle eventually altering the single spring's rest position or placing unequal stress on two opposed springs. The Schlage device is apparently designed to maintain symmetrical force around at least one immovable centering tab. Therefore, even if the symmetrical nature of the device was somehow defeated, the user would be required to manually oppose the bias in order to mount the respective parts, because of the immovable nature of the centering tab.

According to the present invention, not only a heavier spring, but also a movable home position may be associated with the trim mounted on the surface of the door. Users need not therefore overcome worst-case biasing forces in order to use various operators, including lever handles. Installers need not overcome biasing at all in order to align the trim for correct installation.

SUMMARY OF THE INVENTION

It is an object of the invention to provide a surface mounted trim mechanism that adapts a range of handles, including lever handles, to a standard latch mechanism.

It is also an object of the invention to facilitate installation of a trim mechanism having means for biasing rotation of a spindle carried by the trim mechanism.

It is another object of the invention to minimize insofar as possible the rotational force required to operate a latch mechanism.

It is yet another object of the invention to adapt a range of handles, including a variety of levers and knobs, to a given latch mechanism using a bias-adjustable trim plate, the trim plate and overall construction being durable, inexpensive and dependable.

These and other objects are accomplished by a door handle mount for a door having a latch mechanism operable by rotation of a spindle, the spindle extending from the latch mechanism beyond a surface of the door, the spindle being normally held at an angular position on the axis thereof defined by the latch mechanism, the mount comprising a lever handle rotationally fixed on the spindle, the handle being cantilevered on the spindle, gravity urging the spindle to rotate; a trim plate mounted on the surface of the door, the trim plate carrying a spring resiliently opposing rotation of the spindle from an angular home position defined by the spring; and, means for altering the angular home position of the spring. The door handle mount preferably employs a rotational element disposed within the trim plate and fixed with respect to the spindle, a coil spring attached between the rotational element and a portion of the trim fixed to the door body exerting a force at least when the spindle is moved from home position. In order to alter the biasing to accommodate a lever handle of a different weight or moment arm, the abutment point between the spring and either the trim or the rotational element can be angularly displaced to change the amount of biasing force. Although such angular displacement increases the rotational force required to operate the latch mechanism, the adjustable nature of the device allows the increase in rotational force to be set to the minimum required for optimum operation with a particular lever handle.

BRIEF DESCRIPTION OF THE DRAWINGS

There are shown in the drawings the embodiments which are presently preferred. It should be understood, however, that the invention is not limited to the precise arrangements and instrumentalities shown in the drawings, wherein:

FIG. 1(*a*) is a detail exploded perspective view of a portion of the mount of FIG. 1;

DETAILED DESCRIPTION OF THE PREFERRED EMBODIMENTS

Figures 1, 1A:
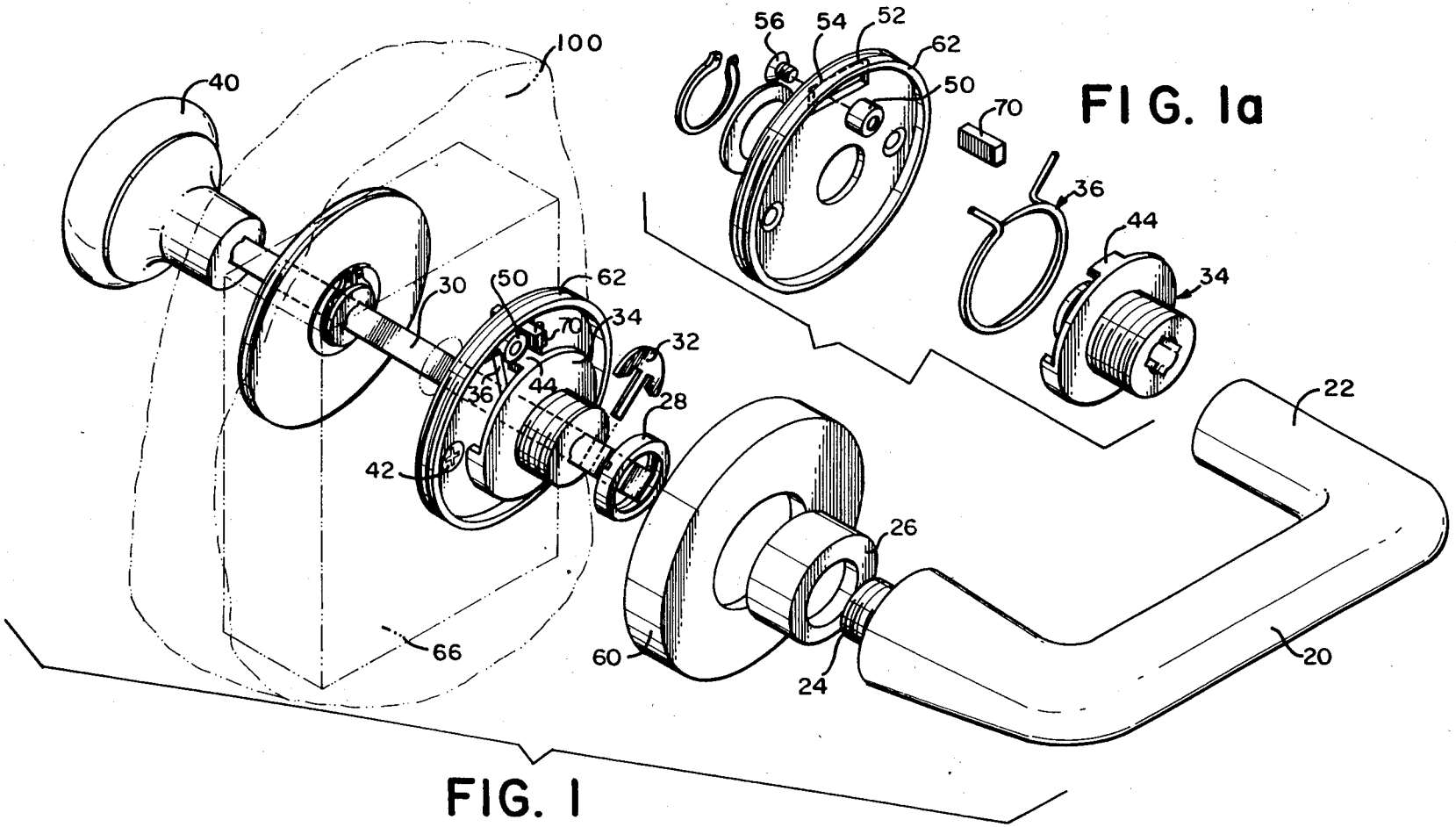
FIG. 1 is an exploded perspective view of the handle mount of the invention, the door being shown in phantom.

According to the invention, the weight which is applied externally to the spindle of a latch mechanism by use of a non-symmetrical handle is offset by a movable biasing arrangement in the trim mechanism. As shown in FIG. 1, the parts required to accomplish offsetting or biasing the lever handle or other operator are all mounted at the surface of a door 100, whereby the particular latch mechanism 66 can be standardized for a symmetrical or light-weight operator, rather than the worst cantilevered operator. The trim offsets the load produced by the handle. The latch mechanism may be a light-weight or easily operated device, rather than a heavily biased mechanism in which springs for maintaining spindle position are chosen to offset the worst case expected load.

With reference to FIG. 1, different operators may be used even on opposite sides of the same latch. Cantilevered handle 20 is shown mounted on one side of door 100, and symmetrical knob 40 on the other side. Spindle 30 may be a two-segment device in which relatively rotatable ends are centrally attached by means of a threaded connection 38 (shown in FIG. 3), or the spindle 30 may be a rigid monolithic element, whereby the operation of either knob 40 or handle 20 would cause the opposite operator to rotate as well.

Handle 20 and knob 40 differ in that handle 20 is cantilevered with respect to the axis of spindle 30, and knob 40 is symmetrically weighted. Therefore, the force of gravity will urge spindle 30 to rotate (clockwise in FIG. 1) to place the center of mass of handle 20, spaced from the axis of spindle 30, at the lowest possible point. Handle 20, as shown in FIG. 1, comprises a backward-turned extension 22 at the end of handle 20 oppo-

DOOR HANDLE MOUNT

BACKGROUND OF THE INVENTION

1. Field of the Invention

This invention relates to the field of door latch apparatus, and in particular to a trim apparatus to be paired with a handle and mounted externally from the lock, the trim apparatus being adapted to the physical attributes of the particular handle, to cancel any variation in operational effects of the handle from a norm, for example, the cantilevered weight of the handle.

2. Description of the Prior Art

Closure mechanisms for doors are more and more frequently designed with lever handles rather than doorknobs to effect retraction of a bolt or the like. Handle mechanisms are usually cantilevered on a spindle, that is, a substantial portion of the weight of the lever handle is disposed asymmetrically around the axis of the spindle, whereby the force of gravity urges the spindle to rotate. The latch mechanism is normally spring-biased against rotation of the spindle, but with a very long or heavy handle, it may be necessary to somehow bias the lever handle to stay at a home position in order to prevent spontaneous opening of the latch mechanism.

Although use of a lever handle causes an uneven weight to be mounted on the spindle, such a lever handle is much easier for people to operate than the conventional doorknob in which the user-gripped portion of the latch is a smooth body having portions symmetrically distributed around the axis of the spindle. Lever handles are normally easier to grasp than knobs, and allow the user greater leverage on the spindle to cause retraction of the bolt mechanism and open the door. Lever handles are therefore preferable over knobs in many instances. In some instances, lever handles are a necessity, for example, closures adapted for use in areas where users may be expected to be frequently carrying loads, and public buildings and the like which must be fully accessible to handicapped persons.

Standards for lever handles for use by handicapped persons go beyond the simple requirement of a cantilevered lever portion. A handle contour in the shape of a "C" is required according to some standards such that the greater part of the body of the lever handle is spaced (e.g., 2 in. or 5.0 cm.) from the door, and the extreme end of the lever handle will be disposed within a minimum distance (e.g., 0.5 in. or 1.3 cm.) of the surface of the door. The additional weight due to the segment spacing the end of the lever handle within the minimum distance required by the standards, results in a substantial additional weight placed well away from the turning axis of the device, that is, the spindle. Of course, a relatively smaller weight placed at a greater distance from the axis will have the same rotational force, or "moment arm," as a relatively larger weight placed closer to the axis.

Use of a lever handle on a latch mechanism in which the spindle is rotatable in either direction is difficult because of the uneven load of the lever handle. It has been known in the art to bias cantilevered lever handles against the force of gravity by use of a positive stop defining a "home" position of the latch mechanism, the stop restricting spindle rotation to one direction. U.S. Pat. No. 2,470,771—Harvey discloses a lever handle and bolt retraction mechanism in which a coil spring wrapped around a hub attached to the spindle, within a mortise lock, biases the spindle against angular displacement from a home position. An additional coil spring mounted on a shaft carrying the retractable bolt also urges the hub and spindle to rotate opposite the bolt retraction direction. In other words, the bolt spring biases the lever handle upwards against the force of gravity, an extension of a hub mounted to the spindle being resiliently urged against an immovable abutment within the latch mechanism.

According to devices such as that of Harvey, it is known in the art to oppose the weight of a lever handle by biasing the handle upwardly against a stop. The rest position of the lever handle may therefore be set at precisely horizontal, for optimum accessibility and neat appearance. No sagging of the handle position is expected because handle position does not relate to a balancing of springs which will wear and sag. During wear of the biasing springs in even a positively stopped latch, however, a lever handle which is inadequately biased upwards will tend to sag, leaving play in the lock and possibly causing spontaneous opening of the door. A lever handle which is disposed at all below horizontal in its rest position is noticeably sloppy in appearance. Therefore, it is conventional practice in the prior art to strongly bias the lever handle upwards.

According to prior art devices having a given biasing spring associated with a part of the latch mechanism for upwardly biasing the position of the lever handle, regardless of the handle or knob mounted on the spindle in a particular installation, the full upward force defined by the biasing spring remains. This bias is determined by the latch mechanism and is not variable as required for a certain handle. Therefore, the user of any latch mechanism was necessarily required to exert sufficient force to overcome the biasing built in for the worst case situation, that is, for a heavy cantilevered lever handle mechanism.

The present invention takes a different view of the use of lever handles, knobs and the like. According to the invention, the latch mechanism is provided with the minimum, rather than the maximum, force necessary to maintain the home position of the spindle. In other words, the internal portion of the latch mechanism is adapted for reliable operation with the lightest of possible handles, rather than the heaviest. External trim fittings which are matched to the particular desired handle, offset the weight of the handle. Accordingly, it is possible to provide a nearly balanced, easily operated latch mechanism and a more or less biased external trim plate, as needed to balance the physical attributes of the particular knob or handle.

The variable bias trim mechanism according to the invention is accomplished using a movable "home" position defined by springs in the trim. The mechanism is useful not only for accommodating various handle mechanisms and various moment arms, but also for accommodating opposite handle mountings in which the direction of the spring bias must be reversed. According to the invention, one need only move the adjustable portion of the trim plate that defines the bias spring home position from one side of center to the other, in order to change the trim bias from clockwise to counter-clockwise. Accordingly, the trim is equally operable to bias lever handles on both sides of the door, a lever handle on one side and knob on the other, or as may otherwise be required for a range of handle members.

site the spindle end, aggravating the tendency of spindle 30 to rotate, due to the moment arm, or leverage, exerted by weight 22 as spaced from the axis of spindle 30.

Both handle 20 and knob 40 are bored and broached to be axially mounted on spindle 30 and rotationally fixed thereto. Knob 40 and handle 20 are also preferably axially fixed to spindle 30, for example, by means of transverse set screws directed against spindle 30, as known in the art. As shown in FIG. 1, in a preferred embodiment, handle 20 is axially fixed to a flanged cylinder 26 by means of a nut 28 which is threadably affixed to an extension 24 of handle 20, after the extension is passed through a close-fitting hole in cylinder 26. Handle nut 28 is not threaded down tightly against cylinder 26, but instead, in order to allow relative rotation of handle 20 and cylinder 26, nut 28 is loosely threaded on extension 24, after which the threads of extension 24 are damaged to prevent removal of nut 28. Cylinder 26 is internally threaded to fit on rosette 34, also bored and broached to fit on the spindle. Upon installation, handle 20 (or knob 40) moves together with spindle 30 and rosette 34.

The axial position of spindle 30 with respect to latch mechanism 66 is determined by spindle pin 32, which passes transversely through a hole in spindle 30. In order to preclude axial movement of spindle 30 in either direction, an additional spindle pin (not shown) should be provided on the knob side of the door. In any event, the protruding portion of pin 32 is larger than the axial hole in the latch mechanism, preventing axial displacement of spindle 30.

The trim is rigidly mounted directly to the surface of door 100 by means of screws 42. Accordingly, the base portion 62 of the trim plate is rigidly affixed to the door. In the event that a trim plate having non-circular external contour is used, it is important to correctly align base plate 62 of the trim plate before attaching it to the door. Use of a circular trim, as shown in FIG. 1, makes the ultimate alignment less important for aesthetic reasons, however, whether a circular or other type of trim plate is used, according to the invention, the trim backplate 62 must be correctly aligned in order to provide an offset force to counteract the cantilevered weight of handle 20. Inasmuch as the bias is in the trim, the trim is urged to rotate with respect to the handle so long as the trim is unattached and/or the handle subject to a stop. Opposing the biasing force inherent in the trim is difficult during installation of the trim, because only the backplate of the trim itself, and the relatively small diameter spindle, are accessible at that time. The installer may therefore need to engage the spindle or trim with pliers in order to oppose the biasing force. According to the invention, however, the bias is adjustable by moving the effective home position, whereby the bias may be cancelled temporarily during installation.

Trim backplate 62 is centrally bored such that spindle 30 may rotate freely with respect to backplate 62. The trim includes the additional rosette element 34, which is rotationally fixed to the spindle, and free to rotate within certain constraints, with respect to trim backplate 62. Rosette 34 is axially attached to backplate 62 using a washer and spring clip. The rotational freedom of motion of rotatable rosette 34, and the resultant freedom of motion of spindle 30, is determined by coil spring 36, which is compressed from its rest position shown in FIG. 1 such that the ends of spring 36 press inwardly on extending pin 50. Pin 50 is rigidly but movably mounted to trim backplate 62 by screw 56. Spring 36 also presses inwardly on tab 44, extending from rotatable trim element 34. The coil spring exerts a force symmetrically inward around a home position determined by alignment of the tab 44 and pin 50. As rotational force is exerted on spindle 30 or handle 20, the spindle 30 and rotatable rosette element 34 rotate. As the spindle rotates, tab 44 carries one or the other ends of coil spring 36 away from pin 50 against the resilient force of the spring. When the handle is released, coil spring 36 recoils toward its rest position and draws tab 44 back into alignment with pin 50, bringing the handle back to its home position. Trim cover plate 60 threads onto backplate 62, concealing and protecting the parts of the device.

The aforesaid operation of coil spring 36 is added to any resilient bias inherent in latch mechanism 66. Latch mechanism 66 may have an internal stop which determines the maximum angular displacement of spindle 30 in one direction or the other. Latch mechanism 66 may also have a built in bias which is intended to offset a predetermined misbalance as might be caused by a lever handle. Any biasing applied to the spindle must be overcome in operating the latch mechanism, and therefore should be minimized. On the other hand, the lack of adequate bias, or an insufficient spring pressure, will cause the handle to droop or sag as the springs deteriorate with age and use under the weight of the handle.

Figure 2:
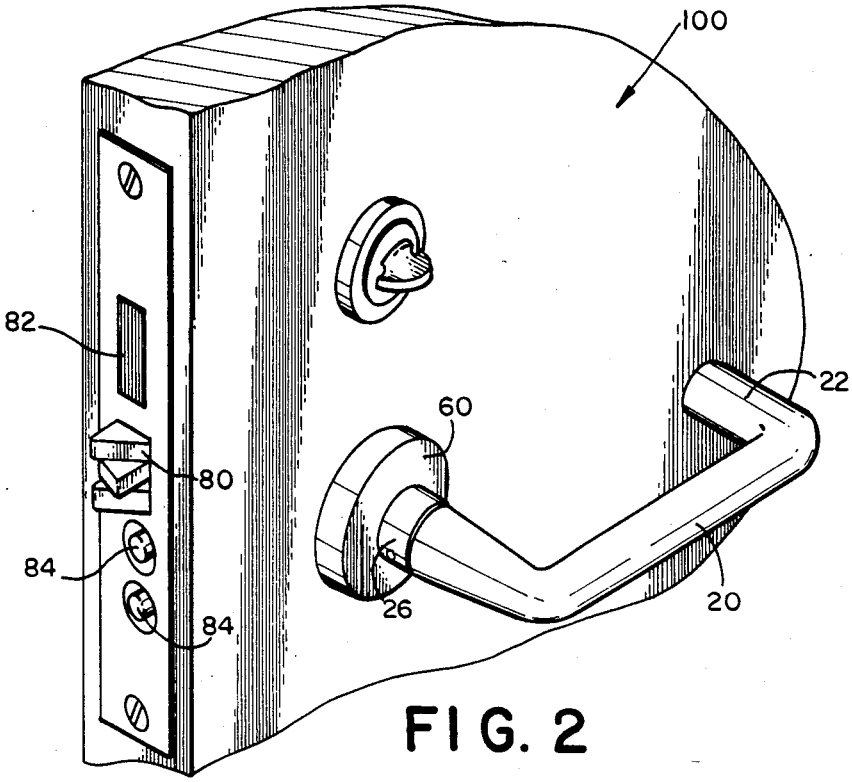
FIG. 2 is a perspective view of the assembled device according to the invention, as adapted for use with a mortise lock.

The handle mount of the invention as assembled is shown in FIG. 2, together with a mortise lock. As known in the art, rotation of the spindle 30 (concealed in FIG. 2) causes withdrawal of latch bolt 80, whereupon door 100 is released from a catch mounted in the door jam. FIG. 2 illustrates the inner or less secure side of the door, as is apparent because a turn piece control, rather than a key, controls extension and withdrawal of the lock bolt 82. Further operations determined by rotation of the spindle via handle 20 will be controlled by the mode changing mechanisms 84, 84 as known in the art.

With reference to FIG. 2, the decorative portion of the trim, including coverplate 60, conceals and protects the mounting means employed. Preferably, coverplate 60 is tightly fastened to the trim backplate 62, the plate 60 being rotated using a spanner wrench. Similarly, threaded cylinder 26, axially affixed to handle 20 but rotatably free thereof, is tightly fastened down on rotatable trim element 34 by means of a spanner wrench. Accordingly, the handle 20, spindle 30 and rosette element 34 rotate together, while coverplate 60 and rearplate 62 remain attached to the door.

In order to comply with modern requirements for accessibility to handicapped persons, handle 20 is preferably provided with a rear-facing extension 22. In order to avoid the extensive rotational load on spindle 30 produced by a large cantilevered weight, it has been conventional to form handle 20 out of hollow stock material, especially at handle extension 22. Various procedures have been undertaken; however, it will be appreciated that a solid metal handle is substantially more durable than a hollow tube, and provides the quality and security needed in a lock mechanism.

Figure 3:
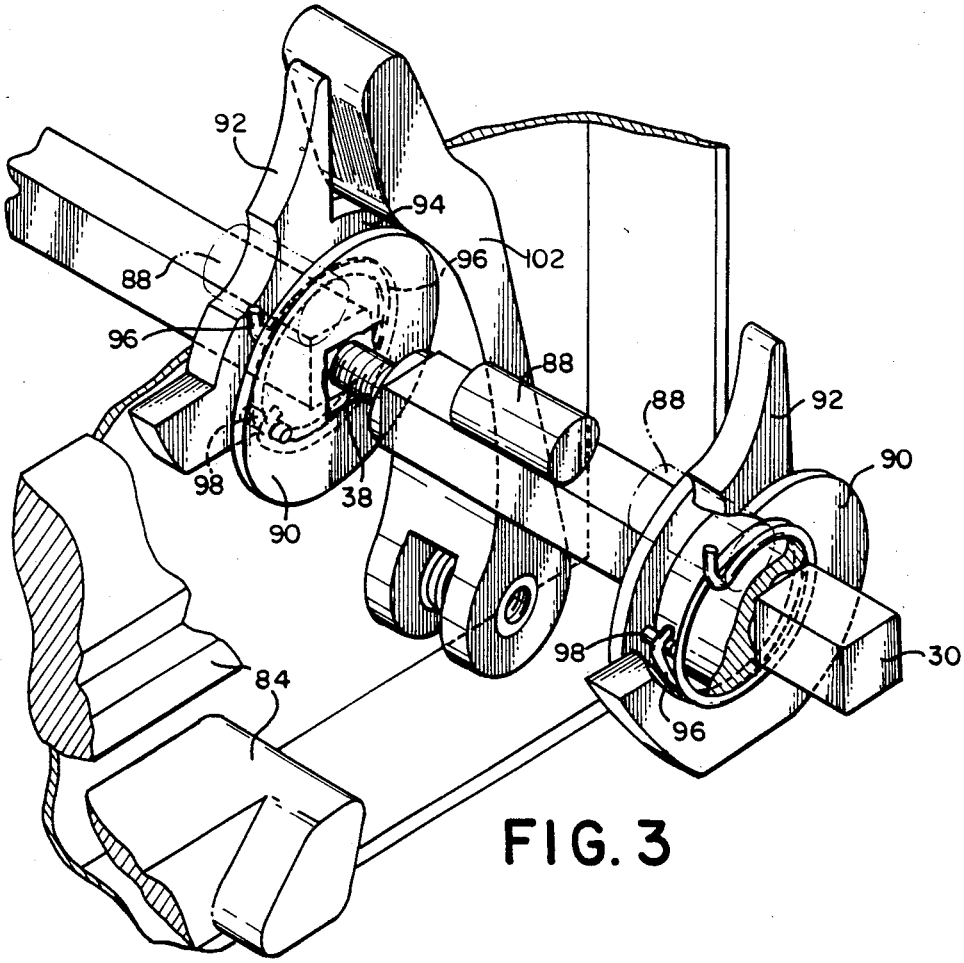
FIG. 3 is a cut-away perspective view of the portion of the mortise lock by which the upward rotation of the lever handle is limited.

As shown in FIG. 3, the internal workings of the mortise lock include one or more means to bias spindle 30 against a positive stop, setting the upward terminus of the lever handle. Hubs 90 are provided for each side of the door, each hub 90 being rotationally affixed to the respective ends of spindle 30. Spindle 30 is centrally divided along a threaded connection member 38, thereby allowing the respective ends of the spindle to independently operate various portions within the mortise lock. As shown in FIG. 3, both hubs 90 comprise extensions 92, which are adapted to rest against stop pin 88. Hubs 90 are urged against stop pin 88 by means of latch bolt operating lever 102, resiliently biased against the rear side of each hub extension 92, and also by a spring carried directly on each hub 90. A slot 94 is formed in the hub for receiving a coil spring 96. Coil spring 96 is wound around the hub and affixed by means of terminal bends to stop pin 86, and also to hub pin 98, affixed to hub 90 and extending to slot 94. The effect is that the spindle can rotate in one direction (clockwise in FIG. 3), but the stop pin defines a home position of the latch mechanism in the other direction.

In order to provide a standard mortise lock mechanism, it is desirable to minimize the biasing force provided by the hub springs 96, 96, by the latch bolt operating lever 102, and by any other effective biasing elements. Such a light-weight or bias-free operation allows ease of operation of the latch and lock in that only a small force on the knob or handle is required in order to rotate the spindle to withdraw latch bolt 80, or to extend or withdraw lock bolt 82. It will also be appreciated that the lack of bias permits use of available force to move the lock elements rather than merely to oppose springs.

The wrapped spring arrangement shown in FIG. 3 is especially adapted for use in a light-weight mechanism. Unlike the arrangement of coil spring 36 to bias rosette 34 against backplate 62 (see FIG. 1), in which the respective ends of the spring are carried by portions of relatively movable elements, there is virtually no relative movement between the ends of spring 96 and the pins 88, 98, to which the spring is affixed. Comparing spring 6 (shown in FIG. 1) and spring 96 (shown in FIG. 3), it will be appreciated that spring 36 will suffer a certain amount of abrasion damage adjacent its ends due to frictional contact with pin 50 and/or tab 44. On the other hand, comparing the spring 96 shown in FIG. 3, as spindle 30 is rotated, the ends of spring 96 do not move with respect to pins 88, 98, but instead such rotation results only in a coiling or uncoiling of spring 96 along its overall length.

It will be appreciated that the spring 36 employed in the trim mechanism can also be formed in a coil having wrapped ends similar to that shown in FIG. 3. It is nevertheless presently preferred that the simple coil spring of FIG. 1 be used in this portion of the latch mechanism, inter alia, because it is applicable to various combinations of handles, passageway latches and mortise locks.

Figure 4:
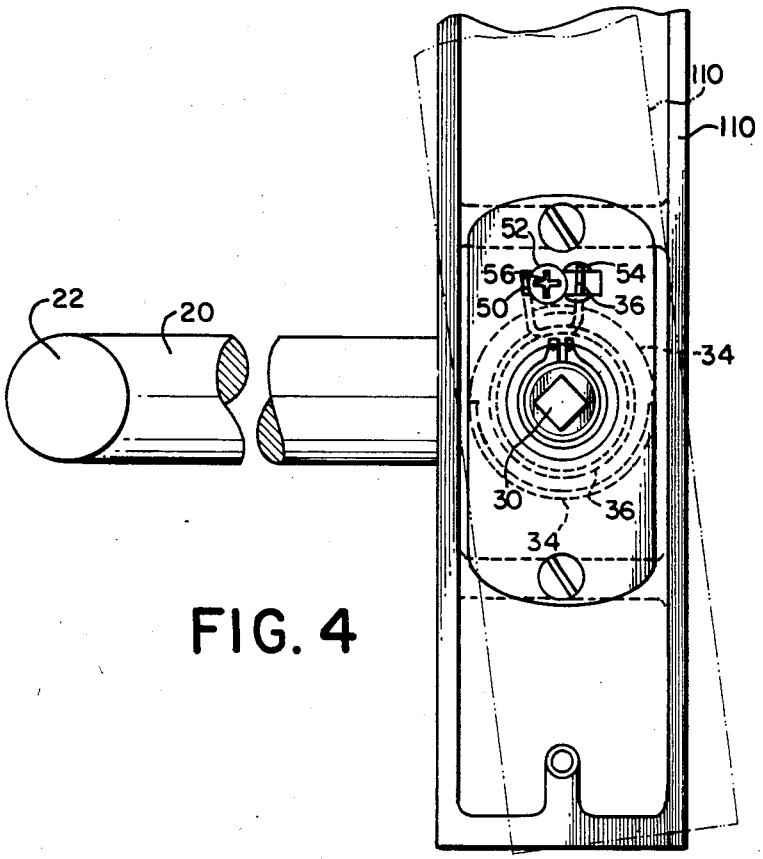
FIG. 4 is a rear elevation view of an alternative embodiment of the invention; and, FIGS. 5(*a*), 5(*b*) and 5(*c*) are perspective views of alternative lever handle embodiments.

FIG. 4 illustrates an alternative embodiment of the invention where an elongated escutcheon-type trim plate 110 is used in place of the threadably attached trim plate 60 of FIGS. 1 and 2. In this embodiment, backplate 62 is attached to the trim plate 110 which trim plate is attached to the body of the door. In other respects, the mechanism is similar. In each preferred embodiment, the position of pin 50 is adjustable as required to set or cancel biasing force from spring 36. Pin 50 is preferably provided with at least two angularly spaced locations at which it can be locked with respect to the trim plate. As shown in FIG. 1, pin 50 is thus positioned either to the left or right of center, and rigidly attached using screw 56. Pin 50 comprises a cylindrical body carrying screw 56, which screw is threadably attachable to the cylindrical body to position pin 50 at any point along a rectangular hole, for example at end positions 52, 54 thereof. The alternate positions 52, 54 may be straight bores, countersunk from the rear of the trim backplate 62, and attached to a threaded bore in movable pin 50. Alternatively, holes 52, 54 can be threaded and the screw 56 inserted from the front.

The embodiment of FIG. 4 is analogous in that movable pin 50 may be placed at predetermined selected positions, thereby altering the bias on the spindle. The bias may be initially set to alternately accommodate either a clockwise or counter-clockwise bias.

Re-positioning pin 50 causes additional pressure to be exerted against the weight of the lever handle, through spring 36, rosette element 34 and spindle 30. Such re-positioning can be thought of as changing the "home" position sought by the trim mechanism in that spring 36 will tend to center rosette element 34, and in particular tab 44, with respect to pin 50. Of course, the actual home position of the mechanism is set by the positive stop pin 88, located within the mortise lock, because regardless of the bias on the spindle, hub extension 92, as shown in FIG. 3, will positively stop rotation of the spindle (counterclockwise) when rested against pin 88. The change of position of pin 50 changes the extent to which spring 36 is deformed. Therefore, rather than a change in actual home position normally assumed by the handle, moving the pin 50 effects a change in spring pressure or bias.

In normal installation on either the clockwise or counterclockwise operating side of the door, the bias tending to relatively rotate the yet-to-be-attached trim with respect to the door, it can be quite difficult to install trim backplate 62 or escutcheon plate 110 at the precise alignment required. Therefore, as shown in FIG. 1, the biasing trim device preferably also comprises a removable spacer, the dimensions of which spacer are selected to precisely cancel the spring bias resulting from the off-center placement of pin mounting holes 52, 54. For example, when pin 50 is mounted at the left position, spacer 70 is set next to pin 50 on the right, and the respective ends of coil spring 36 are crossed to rest against pin 50 on one side and spacer 70 on the other side. With spacer 70 in place, the "home" position of trim backplate 62 is dead center. In this manner, the trim alignment, defined for example by the mounting holes for screws 42 in FIG. 1, may be set precisely horizontal, without the inconvenience of resisting the bias during installation as plate 62 is attached to the door. Similarly, as shown in phantom in FIG. 4, the biasing-determined respective angles assumed by the trim and handle can be cancelled by means of such a spacer, whereupon escutcheon plate 110 may be precisely and vertically aligned with respect to the door. Having correctly placed the mounting holes, the installer removes the spacer, and manually draws escutcheon plate 110 back to vertical for attachment to a rear-directed attachment means (not shown). Finally, after installation, the trim plate, rather than the latch mechanism, provides the bias force which positively holds handle 20 at its upward maximum position.

Figure 5A:
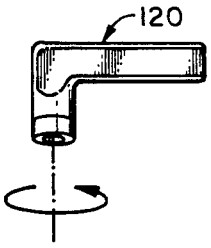
Figure 5B:
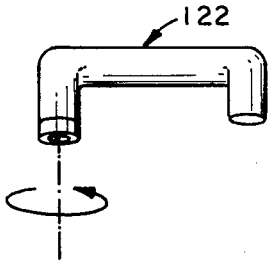
Figure 5C:
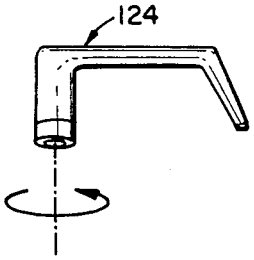

The precise amount of bias required to most dependably cancel the cantilevered weight of a lever handle will, of course, depend upon the precise construction of the handle. A few alternative lever handle shapes are illustrated in FIGS. 5(*a*), 5(*b*) and 5(*c*). The handle 120 of FIG. 5(*a*) could be expected to present a medium weight. In FIG. 5(*b*), the addition of the rear-extending portion intended to bring the end of the handle to within a given distance from the surface of the door causes a much larger angular imbalance on the spindle for handle 122, and requires a greater bias. FIG. 5(*c*) illustrates a compromise embodiment handle 124 in which the rear-extending portion of the lever handle is angled, and therefore at least a part of the weight of the handle is located closer to the axis of the moment arm, namely, spindle 30.

For a neat appearance, the lever handle must never dip below horizontal. Even a small sagging of a lever handle is easily noticed and appears very sloppy. It is presently preferred that the home position of the lever handle, as defined by stop pin 88, be set slightly above horizontal, with respect to the placement of the trim plate screws and the like. This deliberate upward displacement, for example, of one degree, makes it less likely that a minor error in aligning the mounting screws will result in a downwardly-directed handle. The small additional misalignment in an upward direction is much less noticeable than any sag, and results in an acceptable appearance.

The particular bias imparted by the coil spring 36 should be chosen based upon the particular lever handle employed. As well known, the force exerted by a spring is proportional to its displacement from a rest position. Therefore, the biasing force will be determined both by the physical dimensions and characteristics of the coil spring, and also by the extent of angular displacement. It is presently preferred that in order to accommodate a solid brass handle of approximately six inches length, medium gauge coil spring 36 be biased to approximately eight degrees from its home position, that is, the already resiliently engaged position in which extension 44 and pin 50 are aligned. This requires drawing spring 36 approximately 30–45 degrees from its rest position (see FIG. 1*a*) to the position in which the ends of the coil spring are crossed over to resiliently press inwardly against the stop pin 50 and extension 44 (see FIGS. 1 and 4).

The invention having been disclosed, a number of variations will now occur to persons skilled in the art. Reference should be made to the appended claims rather than the foregoing specification as indicating the true scope of the subject invention.

What is claimed is:

1. A door latch, comprising:

a latch mechanism to be disposed in a door;

a spindle extending from the latch mechanism beyond the surface of the door, rotation of the spindle around an axis causing operation of the latch mechanism;

a lever handle fixable on the spindle to rotate therewith, the handle including a weight spaced from the axis such that gravity urges the weight to rotate the spindle around the axis;

a trim plate to be affixed on the door;

a rosette to be affixed on the spindle;

a spring disposed between the trim plate and the rosette;

the trim plate and the rosette each having an abutment disposed against the spring, whereby said rotation is opposed, the abutment of at least one of the rosette and the trim plate being movable and fixable on said at least one of the rosette and trim plate at a plurality of angularly-displaced positions around the axis of the spindle.

2. In a door latch having a latch mechanism to be disposed in a door, a spindle extending from the latch mechanism beyond the surface of the door, rotation of the spindle around an axis causing operation of the latch mechanism, a lever handle fixable on the spindle to rotate therewith, the handle including a weight spaced from the axis such that gravity urges the weight to rotate the spindle around the axis, the improvement comprising:

a trim plate to be affixed on the door;

a rosette to be affixed on the spindle;

a spring disposed between the trim plate and the rosette;

the trim plate and the rosette each having an abutment disposed against the spring, whereby said rotation is opposed, the abutment of at least one of the rosette and the trim plate being movable and fixable on said at least one of the rosette and trim plate at a plurality of angularly-displaced positions around the axis of the spindle.

3. The door latch of claim 2, wherein the trim plate is aligned at a predetermined angle on the door, displaced from an angular home position to which the spindle is urged by the spring.

4. The door latch of claim 2, wherein the spring is a coil spring having at least one turn encircling the rosette, opposite ends of the coil spring being resiliently urged against the abutments, the abutments being a first post mounted on the trim plate and a second post mounted on the rosette, both said posts being radially spaced from the axis, the ends of the coil spring urging the abutments toward one another.

5. The door latch of claim 4, wherein at least one of the first and second posts is threadably attachable to said at least one of the rosette and the trim plate at two angularly-spaced locations around the axis.

6. The door latch of claim 4, further comprising a removable spacer disposed between the spring and the abutment of said at least one of the rosette and the trim plate, whereby removal of the spacer moves an angular home position around the axis, to which the spindle is urged by the spring.

* * * * *